US005467930A

United States Patent [19]

Lefevre

[11] Patent Number: 5,467,930

[45] **Date of Patent: * Nov. 21, 1995**

[54] SOLID WASTE PROCESSING DEVICE

[75] Inventor: Mark S. Lefevre, Lansing, Mich.

[73] Assignee: Lefevre Corporation, Lansing, Mich.

[ * ] Notice: The portion of the term of this patent subsequent to Aug. 23, 2011, has been disclaimed.

[21] Appl. No.: 289,687

[22] Filed: Aug. 12, 1994

Related U.S. Application Data

[63] Continuation-in-part of Ser. No. 134,279, Oct. 12, 1993, Pat. No. 5,340,039.

[51] Int. Cl.[6] ..... B02C 1/06

[52] U.S. Cl. ..... 241/84; 241/94; 241/283; 241/DIG. 38

[58] Field of Search ..... 241/84, 94, 100, 241/82.4, 283, 606, 300, DIG. 38

[56] References Cited

U.S. PATENT DOCUMENTS

| | | | |
|---|---|---|---|
| 94,600 | 9/1869 | Hemenway . | |
| 204,165 | 5/1878 | Oliver . | |
| 206,148 | 7/1878 | Stuart . | |
| 259,949 | 6/1882 | Trumbull . | |
| 1,308,900 | 7/1919 | Gee . | |
| 1,792,522 | 2/1931 | Yates . | |
| 2,090,650 | 8/1937 | Vant | 241/82.4 |
| 2,544,527 | 3/1951 | Crosland . | |
| 3,220,294 | 11/1965 | Bradburn, Sr. . | |
| 3,404,593 | 10/1968 | Arcarese et al. . | |
| 3,469,750 | 9/1969 | Vanderbeck | 241/99 |
| 3,590,674 | 7/1971 | Maeda | 83/14 |
| 3,736,824 | 6/1973 | Dunnican et al. | 83/167 |
| 3,785,233 | 1/1974 | Robinson | 83/167 |
| 3,914,865 | 10/1975 | Oakes | 30/131 |
| 3,988,827 | 11/1976 | Sakamoto et al. | 30/92 |
| 4,035,911 | 7/1977 | Nethercutt et al. | 30/131 |
| 4,255,996 | 3/1981 | Choksi et al. | 83/140 |
| 4,269,364 | 5/1981 | Moriconi et al. | 241/36 |
| 4,275,628 | 6/1981 | Greenhouse | 83/167 |
| 4,404,881 | 9/1983 | Hanifl | 83/167 |
| 4,531,437 | 7/1985 | Szablak et al. | 83/165 |
| 4,565,311 | 1/1986 | Pugliese et al. | 225/94 |
| 4,614,035 | 9/1986 | Andrews | 30/124 |
| 4,729,515 | 3/1988 | Wagner | 241/99 |
| 4,786,280 | 11/1988 | Maeda | 604/110 |
| 4,809,915 | 3/1989 | Koffsky et al. | 241/36 |
| 4,969,379 | 11/1990 | Taylor et al. | 83/167 |
| 4,979,683 | 12/1990 | Busdeker | 241/36 |
| 5,054,696 | 10/1991 | Mennel et al. | 241/34 |
| 5,064,124 | 11/1991 | Chang | 241/33 |
| 5,076,505 | 12/1991 | Petrocy | 241/99 |
| 5,082,187 | 1/1992 | Kirchhoff et al. | 241/84 |
| 5,340,039 | 8/1994 | Lefevre | 241/84 |

FOREIGN PATENT DOCUMENTS 8606314 11/1986 Spain .

*Primary Examiner*—Irene Cuda
*Assistant Examiner*—John M. Husar
*Attorney, Agent, or Firm*—Price, Heneveld, Cooper, DeWitt & Litton

[57] ABSTRACT

The solid waste processing device has an infeed plate with an infeed aperture to receive material into the processing device and has a knife with a knife hole. The knife abuts the infeed plate in sliding engagement and slides between a first position which the knife hole aligns with or overlaps the infeed aperture and a second position in which the knife hole is offset from the infeed aperture. With the knife hole aligned with the infeed aperture, material is fed into the infeed aperture and the knife hole. As the knife slides relative to the infeed plate and moves the knife hole out of alignment with the infeed aperture, the material that extends into the knife hole is shorn off.

20 Claims, 8 Drawing Sheets

SOLID WASTE PROCESSING DEVICE

CROSS-REFERENCES TO RELATED APPLICATIONS

This is a continuation-in-part of U.S. patent application Ser. No. 08/134,279, entitled MEDICAL WASTE DISPOSAL APPARATUS and filed on Oct. 12, 1993, by Lefevre now issued as U.S. Pat. No. 5,340,039, the disclosure of which is incorporated here by reference.

BACKGROUND OF THE INVENTION

The invention relates to solid waste material disposal and specifically to processing solid waste material by reducing or reconstituting the material to a raw material for use or reuse in the manufacture of new products.

The environmental problem of waste disposal is well known to everyone. The volume of solid waste material, more particularly discarded articles and products, has grown to enormous proportions with accompanying disposal problems.

The need for alternative approaches to merely burying discarded articles and products in land fills and the like is abundantly clear.

SUMMARY OF THE INVENTION

The invention addresses the well known solid waste disposal problem, and specifically the problem of processing solid waste materials for recycling by use as a raw material for a subsequent product.

A solid waste processing device according to the invention has an infeed plate and a knife. The infeed plate has a generally planar infeed surface and an infeed aperture extending through the infeed plate. The knife has a first generally planar knife surface abutting the infeed surface in sliding engagement. The knife has a knife hole extending through the knife, and the knife slides relative to the infeed plate to position the knife hole in one of a position of alignment with the infeed aperture and a position out of alignment with the infeed aperture. When the knife hole aligns with the infeed aperture, the solid waste material may fall or otherwise move into the knife hole. When the knife slides relative to the infeed plate and moves the knife hole from a position of alignment with the infeed aperture to a position out of alignment with the infeed aperture, a portion of the waste material that projects into the knife hole is sheared off between the knife and the infeed plate.

In one aspect of the invention, a solid waste material processing apparatus incorporates a solid waste material processing device according to the invention and has a frame, a material infeed connected with the frame, and a material outfeed connected with the frame. The solid waste material processing device is connected between the material infeed and material outfeed so waste material may be fed into the infeed and through the solid waste material processing device with processed waste material being discharged from the apparatus through the outfeed.

In a further aspect of the invention, the knife is a plate member sliding along a axis in an oscillating motion, while in another aspect of the invention, the blade is a circular disc member rotating about a pivot.

These and other features, objects, and benefits of the invention will be recognized by those who practice the invention and by those skilled in the art, from the specification, the claims, and the drawing figures.

DESCRIPTION OF THE PREFERRED EMBODIMENTS

Figure 1:
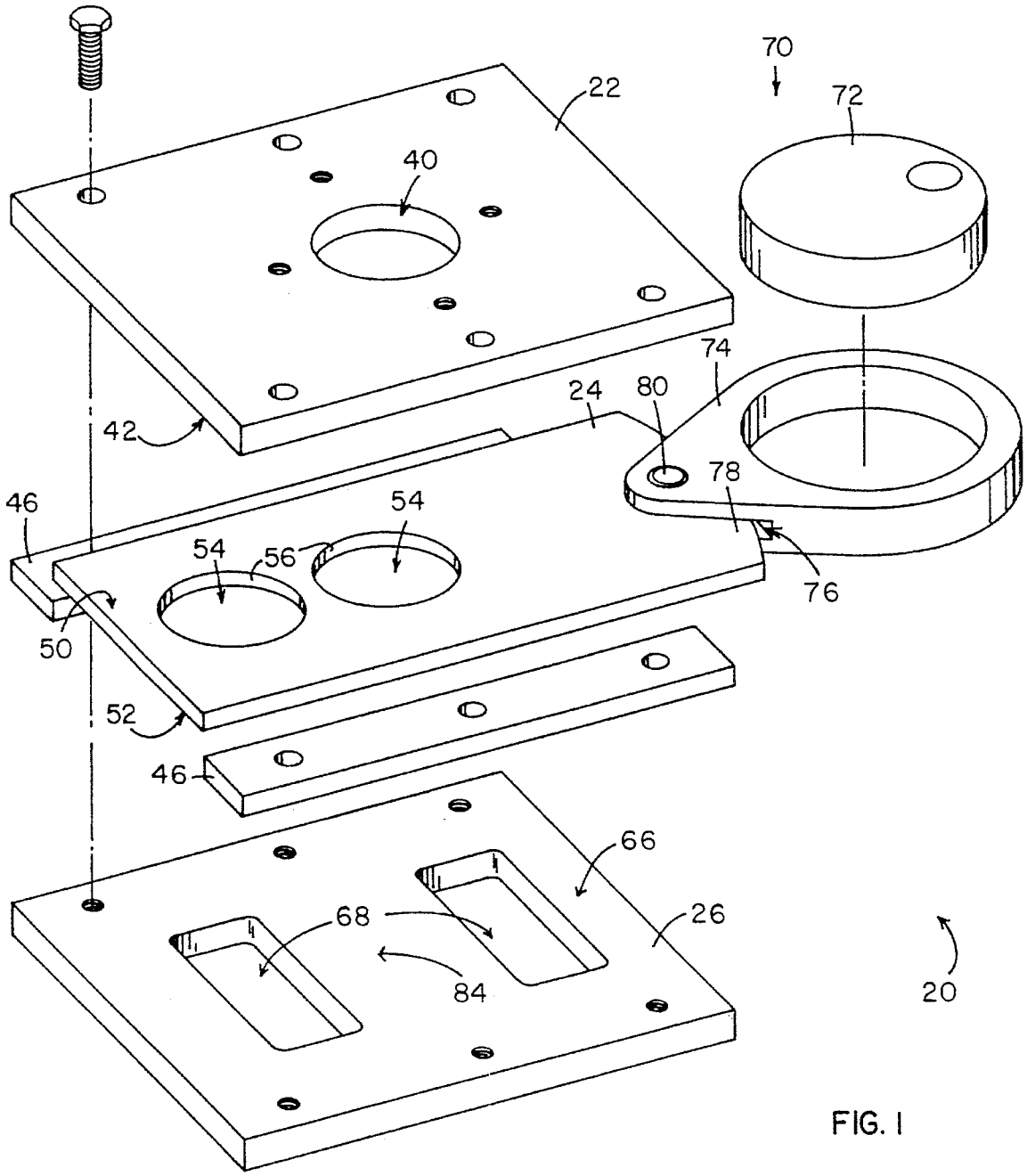
FIG. 1 is an exploded perspective view of a waste material processing device according to the invention.

Preferred embodiments of solid waste material processing devices according to the invention are shown in FIGS. 1–13. A first embodiment is generally referred to by reference numeral 20 (FIGS. 1–5). The material processing device 20 includes an infeed plate 22, a knife blade 24, and an outfeed plate 26. As shown in FIG. 3, processing device 20 will commonly be incorporated in a material processing apparatus 30 which may include a frame 32, a material infeed 34, a discharge 36, and a drive source.

Infeed plate 22 is most preferably formed of a hard cutting material such as a plate of M1 steel, which is commonly known, or of another suitable, hardened, cutting material. Infeed plate 22 has at least one generally planar infeed surface 42 that is oriented to face away from material infeed 34. An infeed aperture 40 is provided through infeed plate 22 to receive material into device 20.

Figure 2:
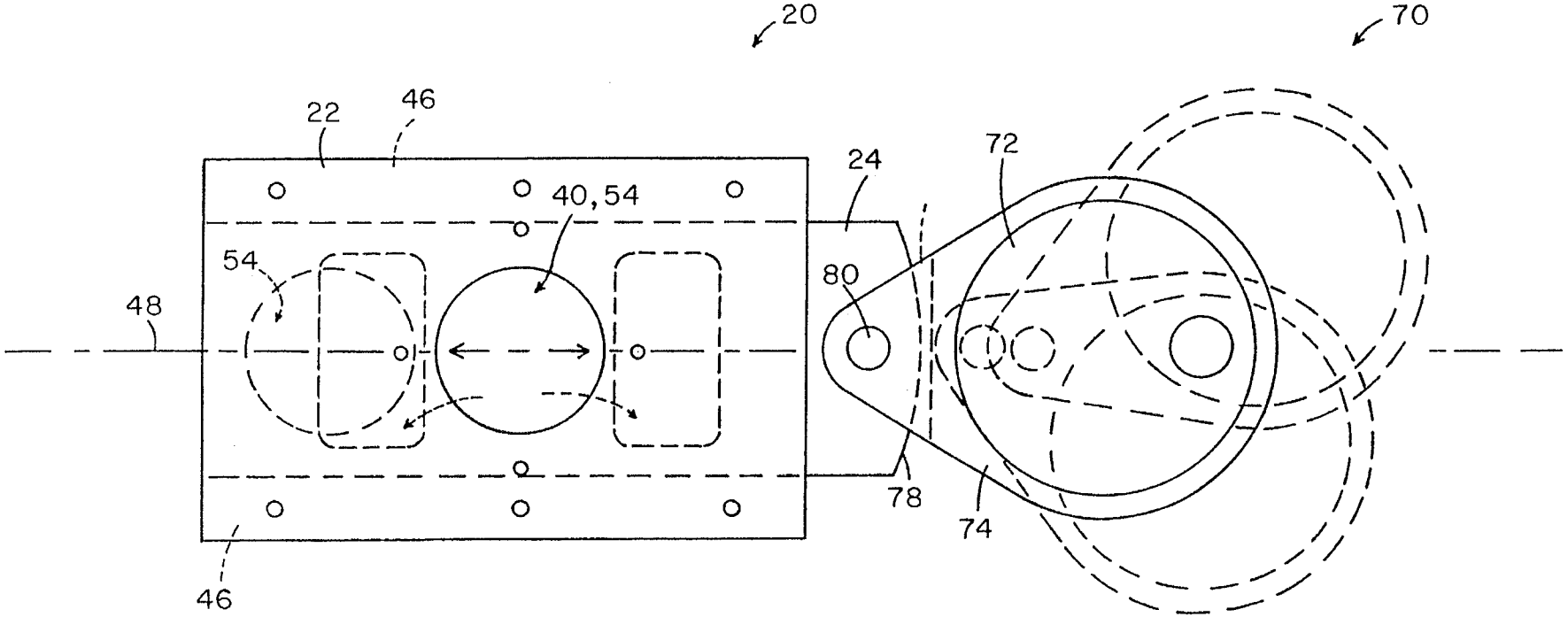
FIG. 2 is a top plan view thereof.
Figure 3:
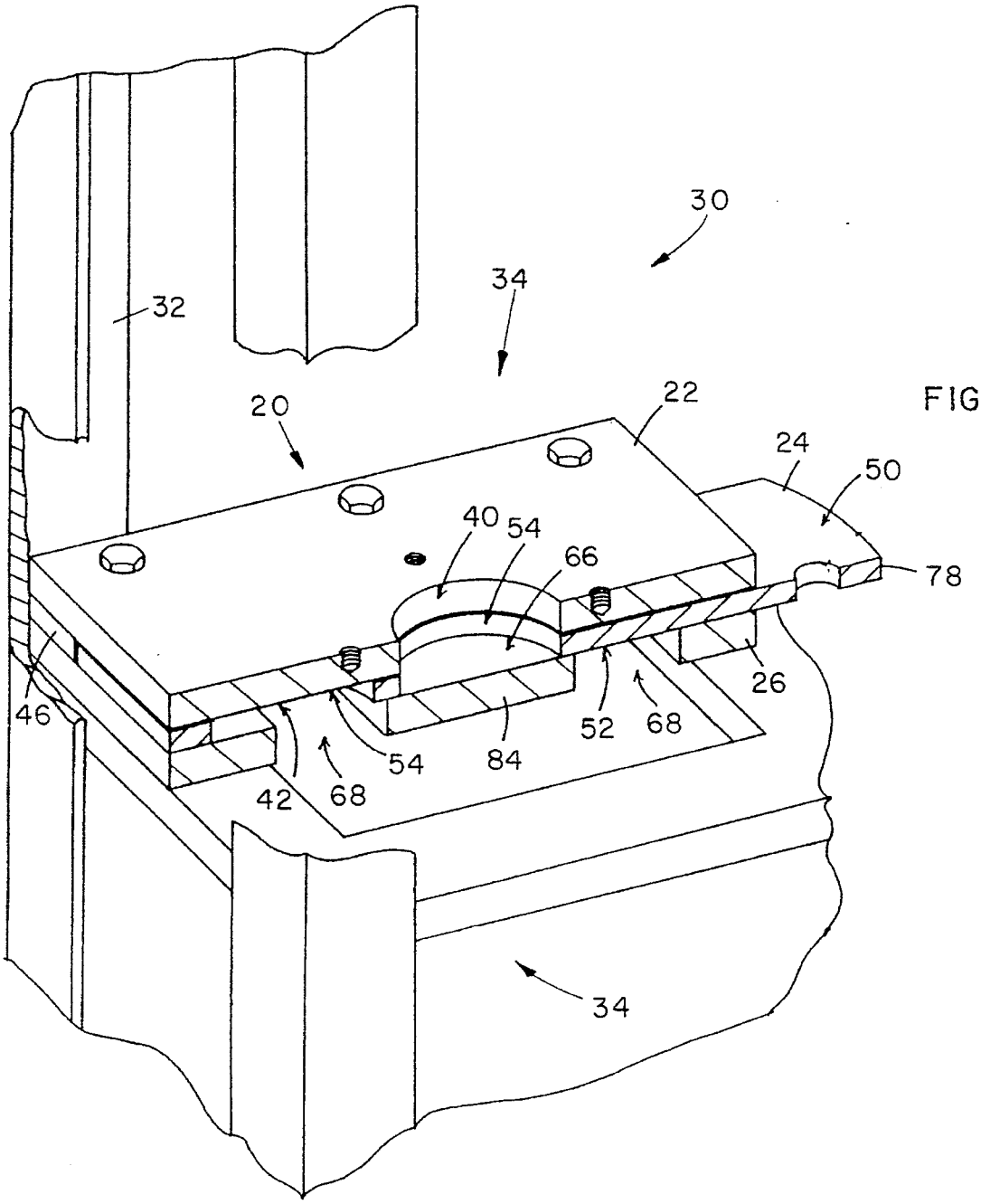
FIG. 3 is a fragmentary perspective view of a waste material processing apparatus incorporating the waste material processing device of FIG. 1 and showing the knife in a first position.
Figure 4:
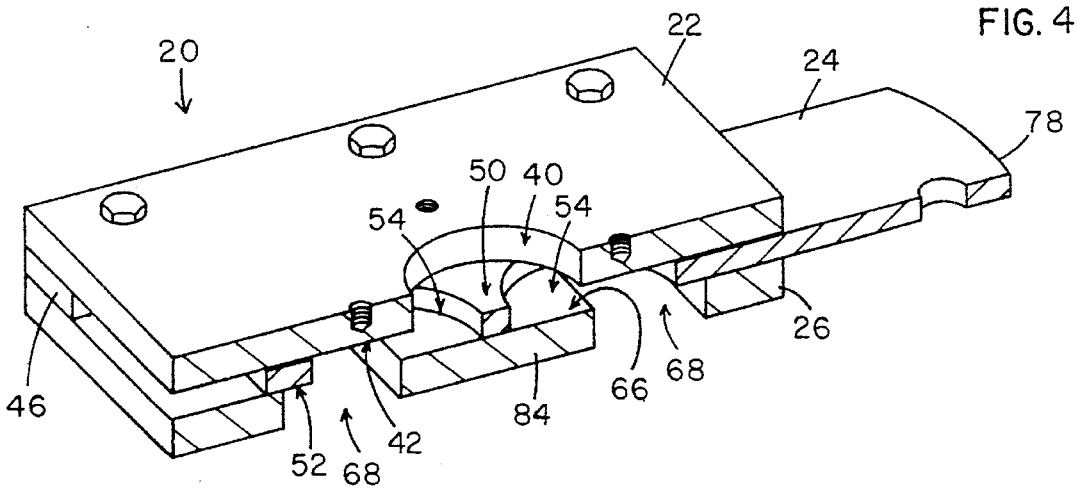
FIG. 4 is a centerline cross-sectional perspective view of the device of FIG. 1 with the knife in an intermediate position.
Figure 5:
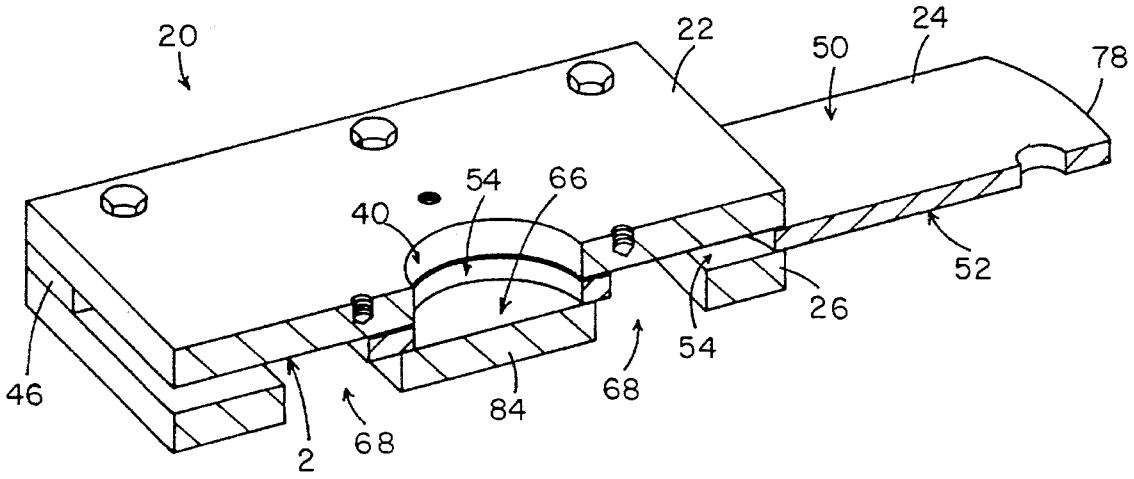
FIG. 5 is the view of FIG. 4 with the knife in a second position.

Knife blade 24 is sandwiched in sliding engagement between infeed plate 22 and outfeed plate 26 (FIGS. 1–5). Thus, spacer plates 46 are sized and positioned along opposing sides of knife blade 24 to provide sliding clearance of knife blade 24 between infeed plate 22 and outfeed plate 26. Spacer plates 46 also function to guide knife blade 24 in sliding along an axis 48 (FIG. 2). Spacer plates 46 may be made of any suitable wear material, including, but not limited to, a bearing brass or bronze and other metals and engineering plastics, for example. Infeed plate 22, knife blade 24, spacer plates 46, and outfeed plate 26 may be fastened together by any suitable means available, including, but not limited to, screws or bolts as is generally shown in the drawing figures (FIGS. 1–5), and combined with knife blade 24 to form the solid waste material processing device 22.

Figure 6:
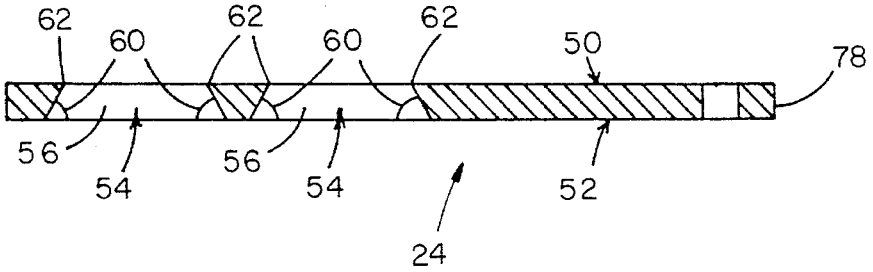
FIG. 6 is a lengthwise centerline cross-sectional view of a first alternative knife configuration.
Figure 7:
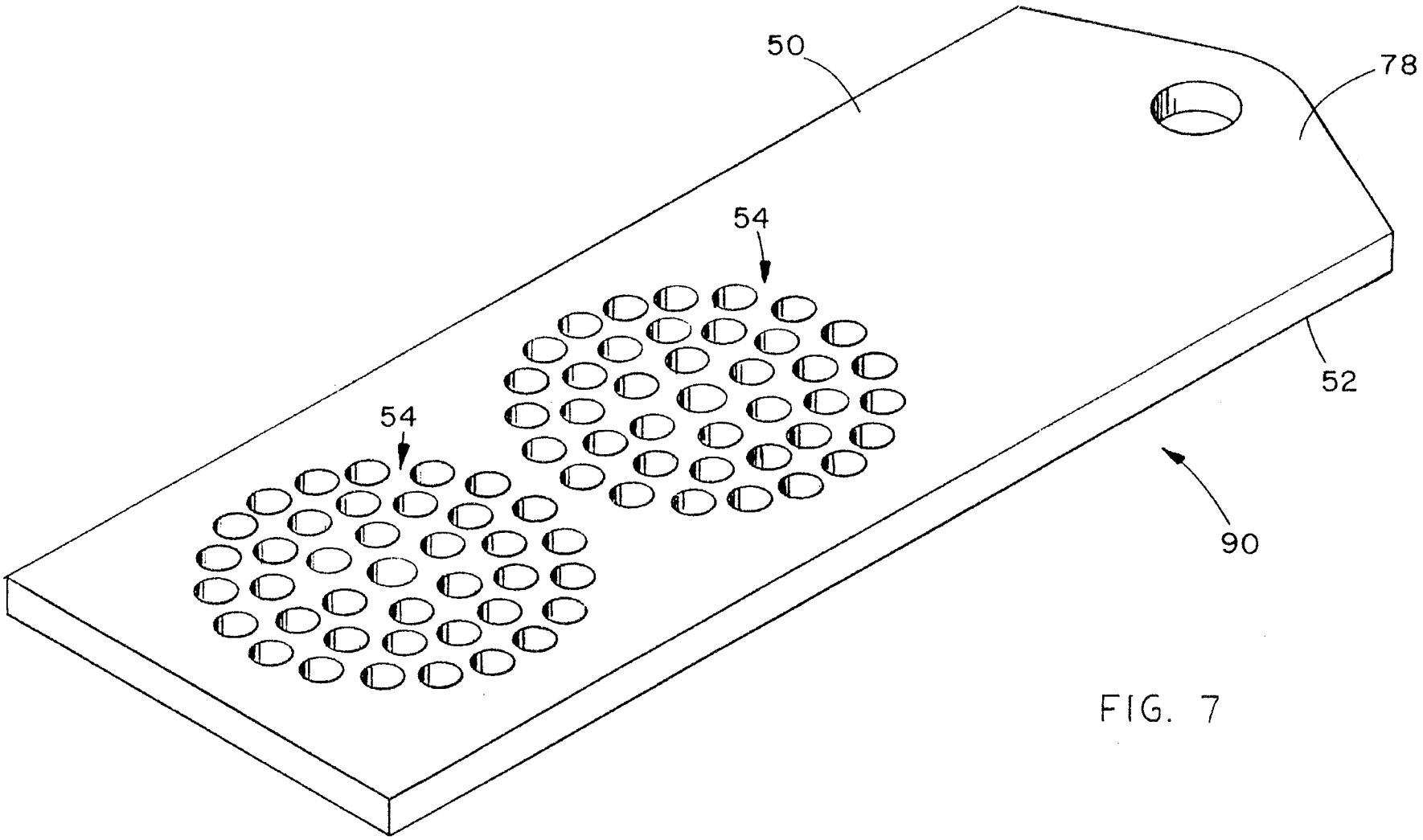
FIG. 7 is a perspective view of a second alternative knife configuration.

Knife blade 24 is a plate member having two opposing planar surfaces 50 and 52 and having at least one knife hole 54. Knife blade 24 is also formed of a hard cutting material such as M1 steel or another suitable, hardened, cutting material. Each knife hole 54 may be a cylindrical opening extending generally perpendicular between the opposing planar surfaces 50 and 52. Alternatively, as shown in FIG. 6, each knife hole 54 may be configured as a conic frustrom with an inclined wall 56 that defines an acute angle 60 between wall 58 and the knife blade surfaces. The inclination of knife hole wall 56 presents an enhanced cutting edge 60 defined between wall 56 and knife surface 50 that enhances the shear cutting action of knife blade 24. To further enhance the cutting action, cutting edge 60 may also be serrated.

As mentioned above, outfeed plate 26 abuts knife blade 24 to sandwich the knife blade in sliding engagement between infeed plate 22 and outfeed plate 26 (FIGS. 1–5). Thus, outfeed plate 26 has a generally planar surface 66 abutting knife blade surface 52. Outfeed plate 26 also has a pair of outfeed openings 68 extending through the outfeed plate. The outfeed openings 68 are spaced from each other, along axis 48 (FIG. 2). Outfeed plate 26 may, but typically will not participate with knife blade 24 in further shearing the material being processed. Thus, outfeed plate 26 may be fabricated of any engineering material that is suitable for sliding engagement with knife blade 24.

As shown in FIGS. 1 and 2, material processing device 20 may be connected with a rotating shaft of a drive source by an eccentric circular cam assembly 70. Cam assembly 70 includes a circular cam 72 eccentrically mounted on a rotatable drive shaft and includes a cooperating crank 74 slip-fit around the cam 72. Crank 74 is formed with a notch 76 to receive an end 78 of knife blade 24. Knife end 78 is pivotally connected with crank 74 by a pivot pin 80 extending through crank 74 and end 78. To minimize wear and enhance durability, an annular bushing may be interposed between circular cam 72 and crank 74.

in use of material processing device 20, eccentric mounting of circular cam 72 upon a rotating shaft will result in the cam rotating within crank 74 and stroking or oscillating of knife blade 24 from a first position (FIG. 3), through an intermediate position (FIG. 4), to a second position (FIG. 5) and back through the intermediate position (FIG. 4) to the first position (FIG. 3), and so on. While knife blade 24 strokes, solid waste material is fed, and may be gravity fed, through infeed aperture 40 of infeed plate 22 and into knife hole 54. The waste material does not continue to fall through processing device 20, but lands upon and is supported by a portion 84 of outfeed plate 26, which is located between outfeed openings 68. Thus, a slice of the waste material that is no thicker than the thickness of knife blade 24 is sheared off as knife hole 54 moves out of alignment with infeed plate aperture 40. The shown piece of waste material is transported by knife blade 24 to an outfeed opening 68 through which the shorn material falls and is discharged from material processing device 20.

Figures 8, 9:
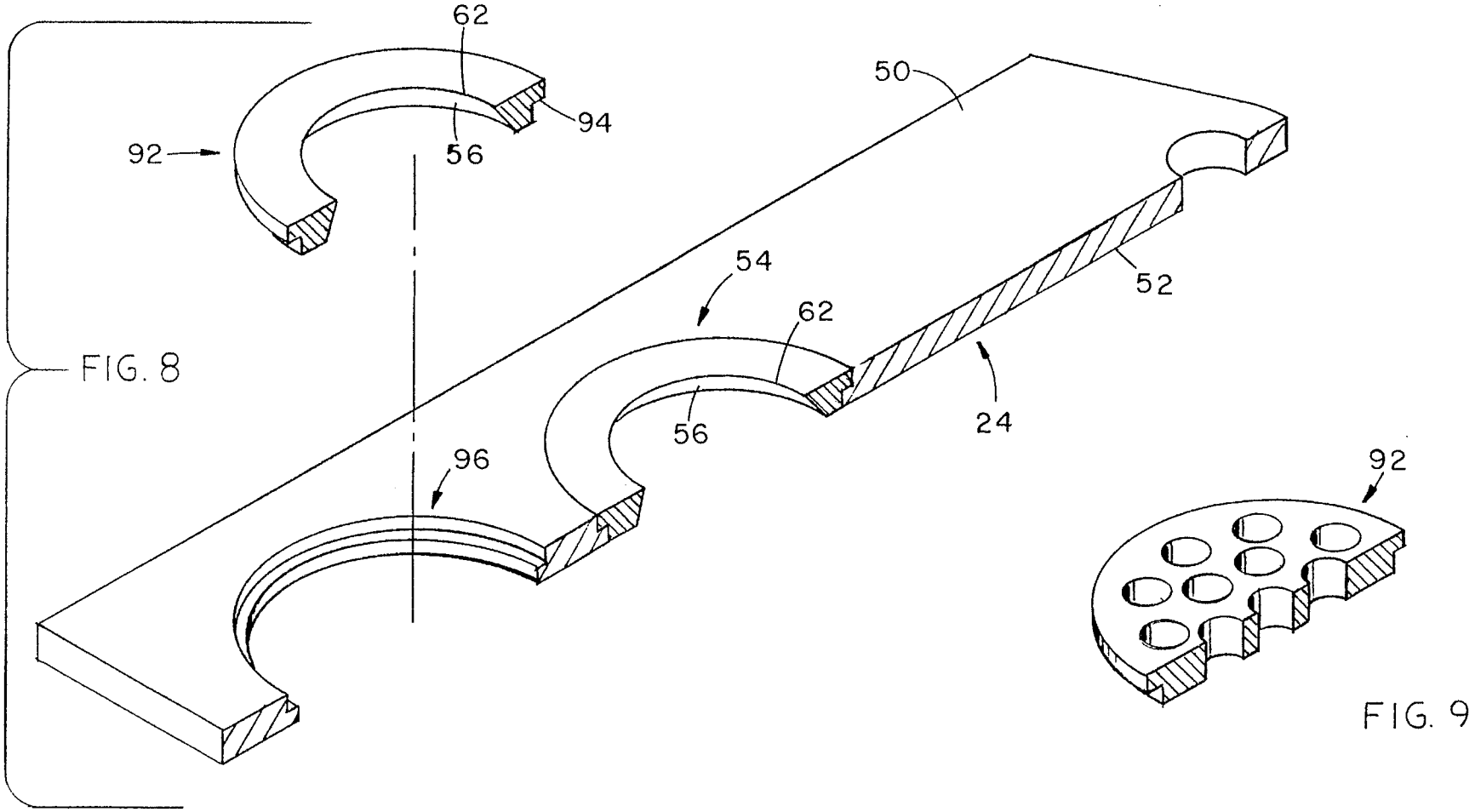
FIG. 8 is an exploded perspective view of a third alternative knife configuration.
FIG. 9 is a fragmentary perspective view of an alternative knife insert used with the third alternative knife configuration of FIG. 8.

As shown by an alternative knife blade 90 (FIG. 7), the configuration of knife hole 54 may include a plurality of knife holes arranged to extend through knife blade 90. Further, knife hole 54 may include an annular knife insert 92 (FIG. 8) having a lip 94 and being adapted to set into a cooperating knife seat 96 in blade 24. Knife insert 92 may be formed from a hardened, cutting material such as M1 steel as discussed above, carbide steel, or the like, while knife seat 96 and the remainder of blade 24 may be made of a milder steel or other suitable engineering material. Knife insert 92 may be keyed to knife blade seat 96 to hold a relative orientation between knife insert 92 and knife seat 96 and prevent rotation of knife insert 92 in knife seat 96. Conversely, knife insert 92 and knife seat 96 may be unkeyed to allow insert 92 to freely rotate in seat 96 and thereby allow uniform wear of cutting edge 62. Of course, knife insert 92 may be provided with a single hole and cutting edge 62 as shown in FIG. 8 or may be provided with a plurality of cutting holes as shown in FIG. 9.

Figure 10:
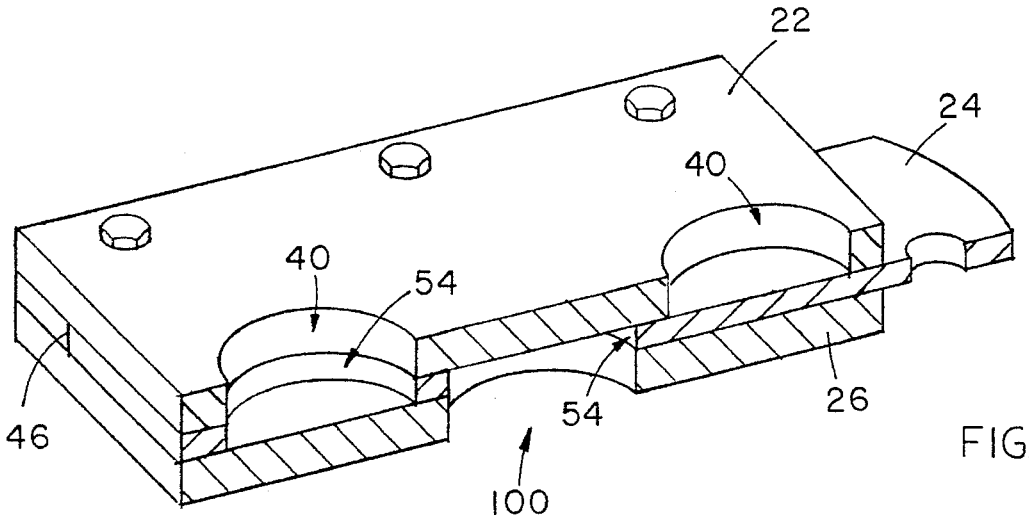
FIG. 10 is the view of FIG. 3 showing the device rearranged with two infeed apertures and one outlet aperture and the knife in a first position.

As it will occur to those who practice the invention, to those who are skilled in the art, and to others, material processing device 20 may be modified as required by a particular installation, including, inverting the respective configurations of the infeed plate 22 and outfeed plate 26 as shown in FIG. 10. Common reference numbers are used in FIG. 10 to identify common elements, including, infeed plate 22 with two infeed apertures 40, knife blade 24 with knife holes 54, and outfeed plate 26 with one outfeed opening.

Figure 11:
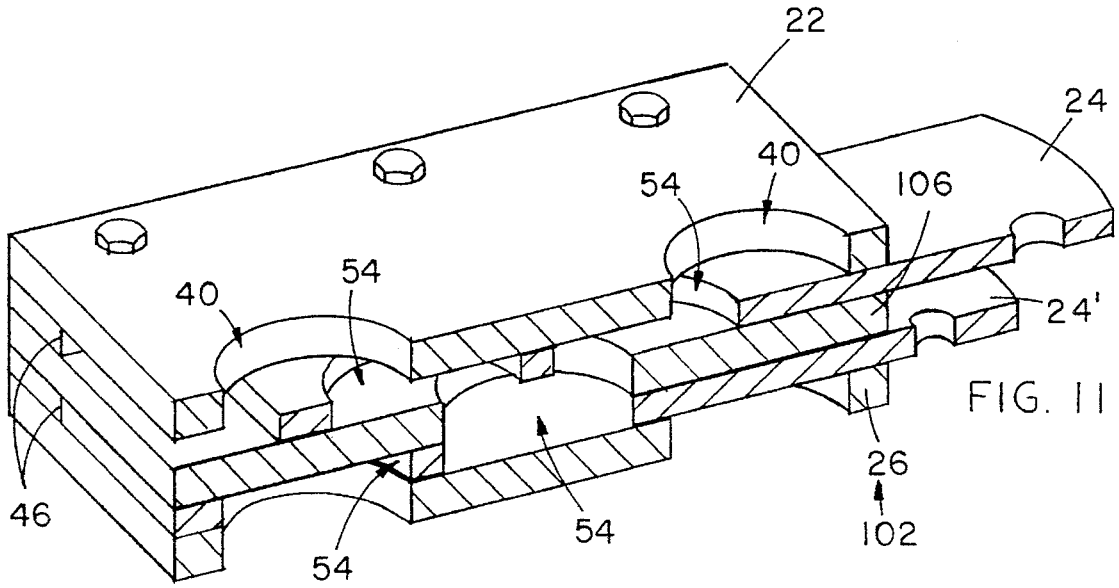
FIG. 11 is the view of FIG. 3 showing a multiple blade configuration of the device of FIG. 1.

Similarly, a multi-bladed embodiment 102 of material processing device 20 may be appropriate for particular installations (FIG. 11). A multi-bladed or stacked material processing device 102 may include an infeed plate 22, a blade spacer 106 interposed between two knife blades 24 and 24' and an outfeed plate 26. Blade spacer 106 serves the dual purpose of being an outfeed plate for the upper knife blade 24 and an infeed plate for the lower knife blade 24'. Thus, as an infeed plate, blade spacer 106 is preferably constructed of a hardened, cutting material as discussed above regarding infeed plate 22 and knife blade 24.

Depending upon the circumstances of the particular installation, the lower knife blade 24' may be identical to the upper knife blade 24 or may have a different thickness than the upper knife blade 24. The lower knife blade 24' may be thinner than upper knife blade 24 and thus provide additional shearing of the material and process the material into even smaller pieces than those shorn by upper knife blade 24.

Figure 12:
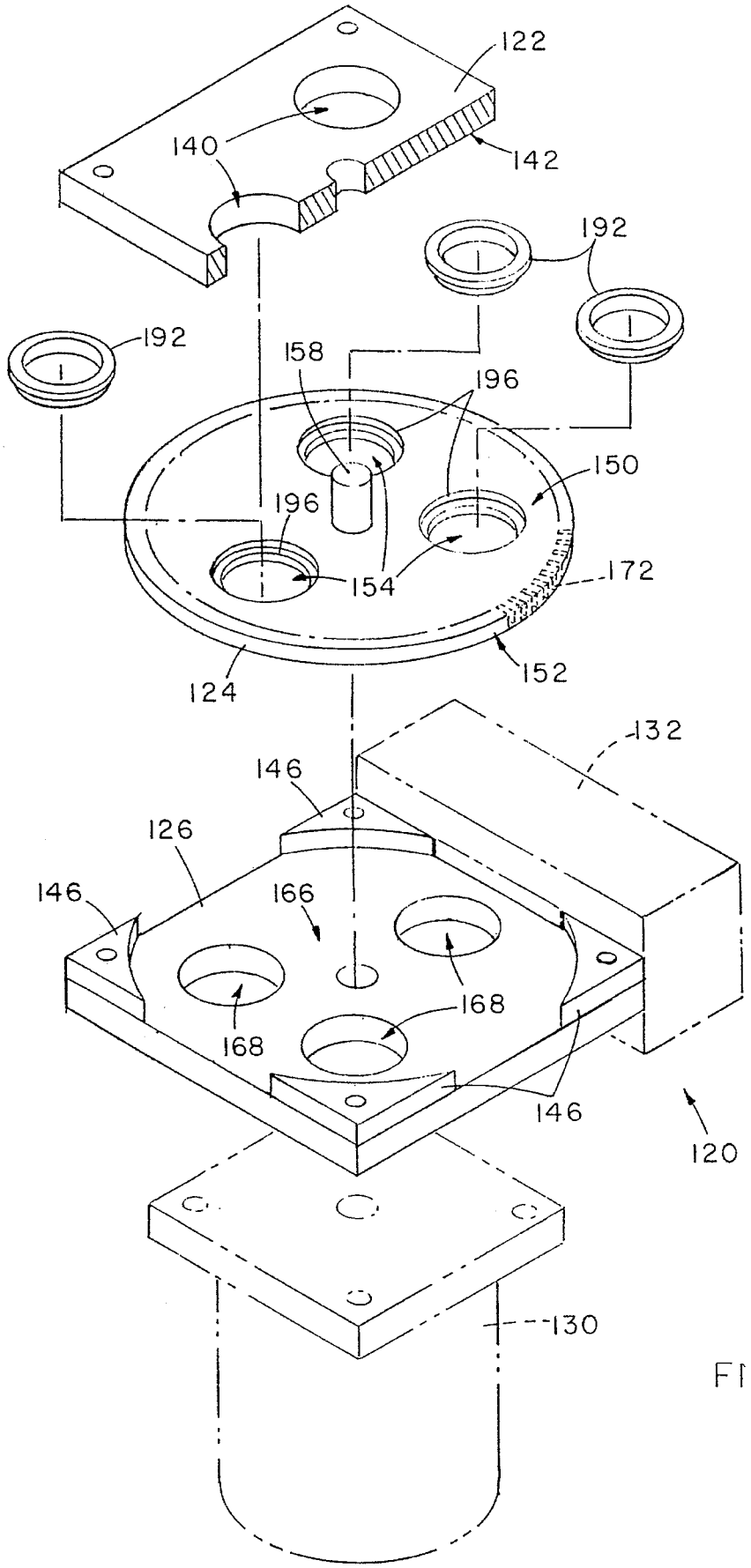
FIG. 12 is an exploded perspective view of an alternative embodiment of a solid waste processing device according to the invention.

A second alternative embodiment 120 of a material processing device according to the invention is shown in FIG. 12. The material processing device 120 includes an infeed plate 122, a knife blade 124, and an outfeed plate 126. Alternative drive sources are shown in phantom at 130 and 132.

Infeed plate 122 is most preferably formed of a hard cutting material such as a plate of M1 steel or another suitable, hardened, cutting material as discussed in greater detail above. At least one infeed aperture 140 is provided through infeed plate 122 to receive material into processing device 120. Infeed plate 122 also has at least one generally planar infeed surface 142 which abuts a generally planar surface 150 of knife blade 124.

Knife blade 124 is sandwiched in sliding engagement between infeed plate 122 and outfeed plate 126. Thus, spacer plates 146 are sized and positioned to provide sliding clearance of knife blade 124 between infeed plate 122 and outfeed plate 126. Spacer plates 146 may be made of any suitable wear material as with spacer plates 46 discussed above. Infeed plate 122, knife blade 124, spacer plates 146, and outfeed plate 126 may be fastened together by any suitable means, also as discussed above.

Knife blade 124 is a plate member having two opposing planar surfaces 150 and 152 and having at least one knife hole 154 disposed radially outward from a central pivot 158. As discussed above regarding material processing device 20, and its knife blade 24, knife blade 124 may be formed of a hard cutting material and is most preferably formed with knife seats 196 which receive cooperating knife inserts 192 as discussed above regarding knife blade 24, knife seats 96 and knife inserts 92.

Outfeed plate 126 abuts knife blade 124 and sandwiches the knife blade in sliding engagement with infeed plate 122. Thus, outfeed plate 126 has a generally planar surface 166 abutting knife blade surface 152. Outfeed plate 126 also has at least one outfeed opening 168 extending through the outfeed plate. As discussed above regarding outfeed plate 26, outfeed plate 126 will typically not participate with knife blade 124 in further shearing and may, therefore, be fabricated of any engineering material that is suitable for sliding engagement with knife blade 124.

As will occur to those who practice the invention, to those skilled in the art, and to others, a variety of drive sources may be used with device 120 and knife blade 124. Only two of the many available drive sources are specifically identified here for the purpose of example. First, knife blade 124 may be connected through central pivot 158 and appropriate gear, shaft, or belt power transmission members with a drive motor 130. Applicant notes that the phantom showing of a drive motor 130 in FIG. 12 is not to suggest that a drive motor should be positioned under outfeed plate 126, although a drive motor may be so positioned, and further notes that directly mounting a drive motor under outfeed plate 126 may interfere with the passage of material through outfeed openings 168. Rather, this is merely one of numerous drive options available. Again, the particular drive arrangement chosen will be dictated by the circumstances of the specific installation using the invention.

A second example of a drive source for knife blade 124 is to provide gear teeth 172 along the perimeter of knife blade 124 for engagement with a worm gear or pinion gear provided as a part of drive 132.

It will be apparent to those who read this disclosure, to those skilled in the art, to those who practice the invention, and to others, that any drive connected with knife 124 may continuously spin knife 124 in a single direction or may alternatively cycle knife 124 between opposing rotational directions depending upon the specific installation of the invention, it will also be apparent that a material processing device according to the invention is not scale specific and is not installation specific, but is applicable over a broad range of installations and applications. That is, the structure of the invention may be scaled for processing relatively small articles and relatively light duty as may be found in a home service environment and may be scaled for processing relatively large articles as may be found in an industrial or commercial waste material processing plant. Thus, installation specifics, including specific dimensions of the components and elements for the embodiments of a material processing device according to the invention, are not spelled out in this disclosure since the specifications will vary according to the particular application and installation of the invention. Rather, it is well within the skills and abilities of those of ordinary skill in the art to perform the necessary engineering calculations and define the appropriate specifications that are suitable for a given use or application.

It will be understood by those who practice the invention and by those skilled in the art, that various other modifications and improvements may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows:

1. A solid waste material processing device comprising:

a frame;

an infeed plate connected with and fixed relative to said frame, the waste material being fed to a first side of said infeed plate, said infeed plate having a generally planar infeed surface on a second side of said infeed plate and having an infeed aperture extending through said infeed plate;

a knife blade with a generally planar knife surface that abutts said infeed surface in sliding engagement, said knife having a knife hole extending through said knife blade; and a drive connected with said frame and operatively connected with said knife blade to slide said knife blade relative to said infeed plate, said drive positioning said knife hole in one of a first position aligned with said infeed aperture and a second position out of alignment with said infeed aperture, the waste material being shorn between said infeed plate and said knife when said drive slides said knife to said second position.

2. The device in claim 1, wherein said knife blade is one of: a member that slides along an axis and cycles between a first position wherein said knife hole is aligned with said infeed aperture and a second position wherein said knife hole is offset from said infeed aperture; and a rotating member that turns about a pivot and cycles between a position in which said knife hole is in alignment with said infeed aperture and another position in which said knife hole is offset from said infeed aperture.

3. The device defined in claim 2, wherein said knife hole has a sidewall defining a cutting edge between said sidewall and said knife surface and wherein said sidewall defines an acute angle with said knife surface.

4. The device defined in claim 3, wherein said knife hole sidewall defines a conic frustrom.

5. The device defined in claim 3, wherein said cutting edge is serrated.

6. The device defined in claim 3, wherein said knife hole is defined by a knife insert, said knife blade has a cooperating insert seat, and said knife insert is removably received in said insert seat.

7. The device defined in claim 6, wherein said knife hole comprises a grouping of a plurality of openings through said knife insert.

8. The device defined in claim 1, wherein said knife hole is defined by a knife insert, said knife blade has a cooperating insert seat, and said knife insert is removably received in said insert seat.

9. The device defined in claim 1, wherein said knife hole comprises a grouping of a plurality of openings through said knife blade.

10. A solid waste material processing device comprising:

a frame;

a material infeed connected with said frame, said material infeed receiving material to be processed by said material processing device;

an infeed plate connected with and fixed relative to said material infeed, said infeed plate having a generally planar infeed surface on a side of said infeed plate facing away from said material infeed and having an infeed aperture extending through said infeed plate, material received by said material infeed being fed through said material infeed and into said infeed aperture;

a knife with a generally planar knife surface that abutts said infeed surface in sliding engagement, said knife having a knife hole extending through said knife;

a material discharge connected with said frame to discharge processed solid waste from said waste material processing apparatus; and a drive connected with said frame and operatively connected with said knife to slide said knife relative to said infeed plate, said drive positioning said knife hole in one of a first position aligned with said infeed aperture and a second position out of alignment with said infeed aperture, the waste material being shorn between said infeed plate and said knife when said drive slides said knife to said second position.

11. The device defined in claim 10, wherein said knife blade is one of: a member that slides along an axis and cycles between a first position wherein said knife hole is aligned with said infeed aperture and a second position wherein said knife hole is offset from said infeed aperture; and a rotating member that turns about a pivot and cycles between a position in which said knife hole is in alignment with said infeed aperture and another position in which said knife hole is offset from said infeed aperture.

12. The device defined in claim 11, wherein said knife hole has a sidewall defining a cutting edge between said sidewall and said knife surface and wherein said sidewall defines an acute angle with said knife surface.

13. The device defined in claim 12, wherein said knife hole sidewall defines a conic frustrom.

14. The device defined in claim 12, wherein said cutting edge is serrated.

15. The device defined in claim 12, wherein said knife hole is defined by a knife insert, said knife blade has a cooperating insert seat, and said knife insert is removably received in said insert seat.

16. The device defined in claim 15, wherein said knife hole comprises a grouping of a plurality of openings through said knife insert.

17. The device defined in claim 10, wherein said knife hole is defined by a knife insert, said knife blade has a cooperating insert seat, and said knife insert is removably received in said insert seat.

18. The device defined in claim 10, wherein said knife hole comprises a grouping of a plurality of openings through said knife blade.

19. A solid waste material processing device comprising:

a frame;

a material infeed connected with said frame, said material infeed receiving material to be processed by said material processing device;

an infeed plate connected with said material infeed, said infeed plate having a generally planar infeed surface on a side of said infeed plate facing away from said material infeed and having an infeed aperture extending through said infeed plate, material received by said material infeed being fed into said infeed aperture;

a knife with two generally planar, opposing knife surfaces, one of said two surfaces abutting said infeed surface in sliding engagement, said knife having a knife hole extending through said knife;

an outfeed plate with a generally planar outfeed surface abutting the other of said two generally planar, opposing knife surfaces in sliding engagement, said outfeed plate having an outfeed opening extending through said outfeed plate, material processed through said knife passing through said outfeed aperture;

a material discharge connected with said outfeed opening, said material discharge discharging processed material from said waste material processing apparatus; and a drive connected with said frame and operatively connected with said knife to slide said knife relative to said infeed plate, said drive positioning said knife in one of a position aligned with said infeed aperture and a position offset from said infeed aperture.

20. The device defined in claim 19, wherein said knife blade is one of: a member that slides along an axis and cycles between a first position wherein said knife hole is aligned with said infeed aperture and a second position wherein said knife hole is offset from said infeed aperture; and a rotating member that turns about a pivot and cycles between a position in which said knife hole is in alignment with said infeed aperture and another position in Which said knife hole is offset from said infeed aperture.

* * * * *